US005177053A

United States Patent [19]

Nagura et al.

[11] Patent Number: 5,177,053

[45] Date of Patent: Jan. 5, 1993

[54] THERMAL TRANSFER IMAGE-RECEIVING SHEET

[75] Inventors: Toshikazu Nagura, Tokyo; Kenji Yasuda, Yachiyo; Michinori Tsuchiya, Ebetsu; Tsunehisa Shigetani; Masaru Kato, both of Tokyo, all of Japan

[73] Assignee: Oji Paper Co., Ltd., Tokyo, Japan

[21] Appl. No.: 645,315

[22] Filed: Jan. 24, 1991

Related U.S. Application Data

[63] Continuation of Ser. No. 336,151, Apr. 11, 1989, abandoned.

[30] Foreign Application Priority Data

Apr. 15, 1988 [JP] Japan ..... 63-91837
Apr. 19, 1988 [JP] Japan ..... 63-94492
Apr. 25, 1988 [JP] Japan ..... 63-100109

[51] Int. Cl.[5] ..... B41M 5/035; B41M 5/38

[52] U.S. Cl. ..... 503/227; 428/195; 428/211; 428/323; 428/328; 428/329; 428/330; 428/331; 428/342; 428/500; 428/513; 428/521; 428/522

[58] Field of Search ..... 8/471; 428/195, 211, 428/513, 913, 914, 340-342, 323, 328-331; 503/227

[56] References Cited

U.S. PATENT DOCUMENTS 4,075,050 2/1978 Takashi et al. ..... 156/229
4,318,950 2/1978 Takashi et al. ..... 428/143
4,778,782 10/1988 Ito et al. ..... 503/227
4,803,194 2/1989 Bracewell ..... 503/227

*Primary Examiner*—B. Hamilton Hess
*Attorney, Agent, or Firm*—Armstrong, Westerman, Hattori, McLeland & Naughton

[57] ABSTRACT

A thermal transfer image-receiving sheet for a thermal transfer type printer comprises a sheet substrate, a front coating layer formed on the front surface of the sheet substrate and comprising a polyolefin resin, a polyolefin resin back coating layer formed on the back surface of the sheet substrate, and optionally, a surface coating layer formed on the front coating layer and comprising a resinous binder and a pigment.

5 Claims, 1 Drawing Sheet

THERMAL TRANSFER IMAGE-RECEIVING SHEET

This application is a continuation of application Ser. No. 336,151 filed Apr. 11, 1989, now abandoned.

BACKGROUND OF THE INVENTION

1) Field of the Invention

The present invention relates to a thermal transfer image-receiving sheet. More particularly, the present invention relates to a sheet for recording thereon images of a thermo-melted or thermal-adhesive ink in a single color or multicolor with a high image sharpness, a high resolution, and at a high reproductivity.

2) Description of the Related Arts

It is known that a new type of printer having a thermal head enables a printing of clear color images or pictures by a thermal transfer of the color images or pictures of a thermo-melting ink or sublimating dye onto a recording sheet, and there is great interest in a further development and utilization of this printing system.

The thermo-melting ink type printer is operated in a manner such that an ink image-receiving sheet is superposed on an ink sheet consisting of a film substrate and a thermo-melting ink layer formed on a surface of the film substrate so that the ink image-receiving sheet comes into contact with the thermo-melting ink layer and the thermo-melting ink layer is partly heated by a thermal head in accordance with electric signals corresponding to the images or pictures to be printed, to thermally transfer the thermo-melting ink images or pictures to the receiving sheet.

In a color printer, color images or pictures are formed by superposing thermally transferred yellow, magenta, cyan and/or black colored images or pictures.

The thermal transfer system using a thermo-melting ink or thermal-adhesive ink is most useful as a small size non-impact printer, for printing Chinese characters and color images.

In the above circumstances, a recording sheet capable of clearly receiving images or pictures thereon is urgently required, together with a clear image-transferring system.

When a record sheet capable of receiving colored images at a high resolution and a high reproductivity is provided, it will become possible to provide hard copies of color pictures, for example, video or computer-graphic colored pictures, by a compact printing machine. Accordingly, this type of recording sheet is expected to be widely utilized for many purposes.

The clarity of the images or pictures printed by the thermo-melting ink image-transferring printer depends on the property of the image-receiving sheet, i.e., only an image-receiving sheet compatible with the type of printer used can record high quality clear images: Namely, the properties imparted to the image-receiving sheet should correspond to the type of printer to be used. For example, when the surface of a conventional fine paper having a Bekk smoothness of 10 to 50 seconds is smoothed with a super-calender or other surface smoothing machine to provide an enhanced Bekk smoothness of 100 seconds or more, the resultant paper sheet can receive thermally transferred ink images having an increased clarity.

In the usual thermal transfer system, the images or pictures are presented in a shade (or single color depth), but recently it has become possible to print continuous tone color images by using a dot-pattern (Dizza) type thermal transfer imaging system.

When the Dizza method is used, the thermal transfer printer must be able to transfer images at a resolution of 16 to 32 dots/mm, and at a higher resolution than picture elements.

Very recently, a new dot area type printer which can control the size of dots to be continuously transferred to an accuracy of 10 μm or less has been reported, and this means that the printer must have an even more enhanced resolving power.

In view of the above-mentioned requirement, it is clear that the conventional fine paper sheet in which cellulose fibriles are exposed on the surface of the sheet is not satisfactory as an image-receiving sheet for current thermal transfer type printers.

To improve the thermal-transferring properties of the thermal transfer type printer, Japanese Unexamined Patent Publication No. 57-182,487 discloses an image-receiving sheet having a coating layer containing an oil absorption pigment and formed on a substrate sheet. This type of image-receiving sheet can receive thermally transferred images having a uniform shade. The pigment usable for the above-mentioned coating layer can be selected from among almost all of those usable for usual coated printing paper sheets but when the printer has a high resolution, the reproductivity of the thermally transferred images is greatly influenced by the evenness of the ink-receiving property of the image-receiving layer of the image-receiving sheet. Accordingly, the use of a conventional coated or non-coated image-receiving sheet sometimes results in an uneven shading of close printed portions and in an unstable transfer of dots, and thus preferable continuous tone images are not obtained with this sheet.

Also, it is clear that the usual fine paper sheet or coated paper sheet is not suitable as a thermally transferred image-receiving sheet able to receive red, blue, and green colored images formed from superposed yellow, cyan and magenta colored dots, with a required evenness and at a high reproductivity.

In the above-mentioned thermal transfer printing system, the conventional thermally transferred bi-level images can be replaced by continuous tone type images.

The density modulation continuous tone type printing systems include a system in which sublimating dyes are utilized and the amounts of the sublimated dyes are controlled by controlling the heat quantity in the thermal head, and a new system of thermo-melting inks is utilized, and the amounts of the inks to be transferred are controlled by adding a filler to the ink layers or by multilayer-coating a plurality of inks having different melting points. The latter is a thermo-melting, density modulation thermal transfer imaging system and is expected to be most suitable for the required purpose.

In this system, a specific ink sheet is used in the printer, ink images are transferred to the surface of the image-receiving sheet by heating and pressing the ink sheet by the thermal head toward the image-receiving sheet. The heating is carried out stepwise to transfer a predetermined amount of the ink to the image-receiving sheet and to form full color images having a density modulation on the sheet.

In the sublimating dye-thermal transfer system, an ink sheet consisting of a thin paper or film substrate and an ink layer containing a sublimating dye and formed on the substrate, is superposed on an image-receiving sheet having a polyester resin layer formed on a sheet substrate so that the ink layer comes into contact with the polyester resin layer, and the dye images are transferred from the ink layer to the polyester resin layer by heating the ink layer by the thermal head in accordance with electric signals. The heating is controlled stepwise to transfer a predetermined amount of the dye and to form images having a predetermined shade.

The evenness and clarity of the dye images are influenced by the quality of the image-receiving sheet, and the quality of the image receiving sheet depends on the quality of the image-receiving layer and the quality of the sheet substrate.

It is known that a biaxially and/or uniaxially oriented, multilayered film consisting of at least one polyolefine resin and at least one inorganic pigment, and a composite sheet consisting of the above-mentioned film and an image-receiving layer formed on the film, are useful as a thermal transfer image-receiving sheet.

The image-receiving sheet for sublimating dyes has an image receiving polyester resin layer formed on the polyolefin resin film. This image-receiving sheet has a uniform thickness, a greater softness and a lower heat conductivity than that of the cellulosic pulp sheet (paper), and thus is advantageous in that the received images have a uniform quality and an excellent shade and color depth.

When a biaxially and/or uniaxially oriented multilayered film consisting essentially of a polypropylene resin is used as an image-receiving sheet for the thermal transfer type printer, the heating by the thermal head of the printer causes the sheet to be partially shrunk, and thus to be curled and/or wrinkled. Sometimes the sheet is partially melted, and thus the travel of the sheet in the printer is obstructed and the resultant print becomes useless. Especially, in the sublimating dye-thermal transfer type printer, the necessary amount of heat to be applied to the ink sheet is large, and thus the polyolefin resin film sheet has serious problems in practical use.

To eliminate the above-mentioned problem, Japanese Unexamined Patent Publication No. 62-21590 discloses an image receiving polyolefin resin sheet having a barrier layer formed on a paper sheet substrate and consisting of an organic polymer material having a higher heat resistance than that of the polyolefin resin. This type of image receiving sheet is disadvantageous in that the evenness of dots formed by the thermal head is greatly affected by the surface smoothness of the sheet, and the resultant images have an uneven shading.

The surface smoothness of the image receiving sheet depends greatly on the surface smoothness of the sheet substrate, and accordingly, the paper sheet substrate must have a satisfactory surface smoothness.

The surface smoothness of the paper sheet depends on the type of pulp, the type of pulp treating method, the type of additives used, the paper-forming conditions, and the post treatment conditions. If a paper sheet having an excellent surface smoothness is provided, the paper sheet can be utilized as a sheet substrate of an image receiving sheet having a thermoplastic resin coating layer formed thereon. The surface smoothness of the thermoplastic resin coating layer depends on not only the type of the resin and the coating conditions but also the smoothness of the sheet substrate. The surface smoothness of the image-receiving sheet necessary for obtaining a high evenness of dots on the surface must be considered in a micrographic area, and the usual Bekk smoothness is not always sufficient to define the necessary surface smoothness.

Furthermore, in the sublimating dye image-receiving sheet, colored images are formed by superposing yellow dye images, magenta dye images and cyan dye images. When the colored image-thermal transferring operation is carried out in a low humidity atmosphere, sometimes static electric charges are generated on the sheet and obstruct the travel of the sheet.

SUMMARY OF THE INVENTION

An object of the present invention is to provide a thermal transfer image-receiving sheet usable for recording thereon heat melting ink or sublimating dye images with an excellent clarity and high resolution, and at a high reproductivity.

Another object of the present invention is to provide a thermal transfer image-receiving sheet capable of recording thereon even and desired shades of images by not only a Dizza printing system but also a continuous tone printing system.

Still another object of the present invention is to provide a thermal transfer image-receiving sheet able to provide an excellent evenness of shades of dots and close printed portions in all ranges of from a light shade to a dark shade.

A further object of the present invention is to provide a thermal transfer image-receiving sheet free from heat shrinkage or deformation even when used with a sublimating dye thermal transfer type printer.

The above-mentioned objects can be attained by the thermal transfer image-receiving sheet of the present invention which comprises a sheet substrate; a front coating layer formed on the front surface of the sheet substrate and comprising, as a principal component, a polyolefin resin material, a back coating layer formed on the back surface of the sheet substrate and comprising, as a principal component, a polyolefin resin material, and a surface coating layer formed on the front-coating layer, which comprises a resinous binder and a pigment wherein the binder consists essentially of at least one member selected from styrene-butadiene copolymer resins, methylmethacrylate-styrene-butadiene copolymer resins, vinyl homopolymer and copolymer resins, acrylic polymer resins, polyvinyl alcohol, starch, casein and polyester resins soluble in an organic solvent, for example toluene.

In still another embodiment of the image-receiving sheet of the present invention, the sheet substrate consists essentially of a paper sheet comprising a cellulosic pulp material having a low viscosity of 5 to 12 centipoises determined in accordance with the method of Tappi T 230, om-82.

DESCRIPTION OF THE PREFERRED EMBODIMENTS

Figure 1:
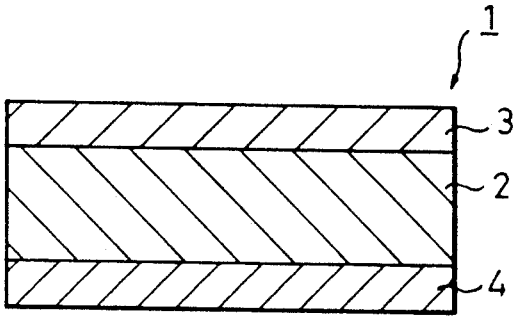
FIGS. 1 and 2 respectively are explanatory cross-sectional views of an embodiment of the image-receiving sheet of the present invention.

In an embodiment of the image-receiving sheet of the present invention as indicated in FIG. 1, an image-receiving sheet comprises a sheet substrate 2, an image-receiving layer 3 formed on the front surface of the sheet substrate 1, and a back coating layer 4 formed on the back surface of the sheet substrate 1.

The sheet substrate usable for the present invention is formed by a paper sheet comprising a cellulosic pulp material. There is no restriction to the type of paper sheet used, but usually a fine paper sheet is used for the sheet substrate. Also, there is no limitation to the thickness, stiffness, and weight of the sheet substrate, but preferably the sheet substrate has a weight of 20 to 250 $g/m^2$.

Generally, the surface smoothness of the image-receiving sheet is influenced by the surface properties and surface smoothness of the sheet substrate. Therefore, the paper sheet to be used for the sheet substrate must have excellent surface properties and smoothness. This feature of the sheet substrate will be further explained hereinafter.

The front coating layer is formed on the front surface of the sheet substrate and comprises, as a principal component, a polyolefin resin material and optionally a white pigment dispersed in the principal component. Preferably, the front coating layer has a weight of 2 to 80 $g/m^2$, more preferably 10 to 30 $g/m^2$.

In the image-receiving sheet as indicated in FIG. 1, the front coating layer 3 comprises a polyolefin resin material.

The polyolefin resin material usable for the principal component in the front coating layer preferably consists essentially of at least one member selected from polyethylene resins, ethylene copolymer resins, polypropylene resins, polybutene resins, polypentene resins, and copolymer resins of two or more of ethylene, propylene, butene, and pentene.

The white pigment usable together with the polyolefin resin material preferably comprises at least one member selected from titanium dioxide, zinc sulfide, zinc oxide, calcium sulfate, calcium sulfite, barium sulfate, clay, talc, kaolin, light and heavy calcium carbonate, silica, and calcium silicate which are usually used as a white pigment for conventional polyolefin resin materials.

The pigment in the front coating layer preferably has an excellent whiteness, is usable for a melt extrude-coating procedure by a laminater, and does not cause a deterioration of the surface smoothness of the resultant image-receiving layer and the bounding property of the resultant image-receiving layer to the sheet substrate.

Where the principal component in the front coating layer consists essentially of a polyolefin resin material, the content of the pigment is preferably from 5% to 20% by weight.

In the image-receiving sheet of the present invention, a back coating layer comprising, as a principal component, a polyolefin resin material is formed on the back of the sheet substrate.

The front coating layer and the back coating layer both comprising the polyolefin resin material can be formed on the sheet substrate by a melt-extrude coating method using a laminater.

The resultant front coating layer has an excellent surface smoothness and whiteness and is suitable for receiving thermally transferred ink images with a high accuracy, sensitivity, and harmony.

The back coating layer may have a matted surface, if necessary. The matted surface can be formed by laminating a layer of a polyolefin resin material on the back surface of the sheet substrate and cooling and pressing the surface of the back coating layer with a cooling roll having a matted peripheral surface thereof in a predetermined pattern so that tee matte pattern of the cooling roll is transferred to the surface of the back coating layer.

Generally, the back coating layer has a weight of 2 to 50 $g/m^2$, preferably 5 to 20 $g/m^2$.

The front coating layer and the back coating layer formed on the sheet substrate effectively prevent undesirable curling of the resultant image-receiving sheet and impart an enhanced resistance to water and to weathering.

The front coating layer and the back coating layer may contain an additive, for example, an antistatic agent antioxidant, stabilizer, plasticizer, dispersing agent, slip-preventing agent lubricant, fluorescent brightening agent, if necessary.

The image-receiving sheet of the present invention may be provided with a surface coating formed on the front coating layer.

Figure 2:
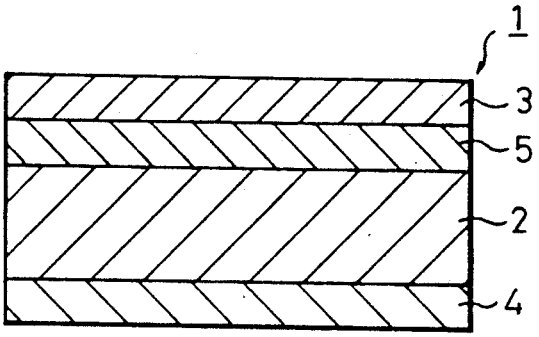

Referring to FIG. 2, an image receiving sheet consists of a sheet substrate 2, a front coating layer 3 formed on the sheet substrate 2, a surface coating layer 5 formed on the front coating layer 3, and a back coating layer 4.

The surface coating layer to be formed on the front coating, layer comprises a resinous binder and a pigment dispersed in the resinous binder.

The resinous binder preferably comprises one member of polyvinyl alcohol, starch, casein and polyester resins soluble in an organic solvent, for example, toluene.

The resinous binder is applied to the front coating layer surface in the form of a solution or emulsion.

Further, the resinous binder may be hardened by radiating actinic rays, for example, electron beams.

The white pigment is in a content of 5 to 90% by weight, preferably 50 to 85% by weight, in the surface coating layer. When the content of the pigment is more than 90% by weight, the resultant surface coating layer sometimes exhibits a poor resistance to cracking. Also, if the content of the pigment is less than 5% by weight, the resultant surface coating layer sometimes exhibits an unsatisfactory opacity and whiteness.

The white pigment usable in the surface coating layer is preferably selected from oil absorbing inorganic pigments consisting of at least one member selected from, for example, calcinated clay, fine silica powder, kaolin, calcium carbonate, titanium dioxide, aluminum hydroxide, talc, and calcium sulfite.

Preferably, the pigment to be contained in the surface coating layer has an oil adsorption of from 30 to 400 ml/100 g determined in accordance with JIS K 5101.

The surface coating layer may contain an additive, for example, an antifoaming agent, dispersing agent, electroconductive agent and/or wetting agent.

The image-receiving sheet of the present invention may be calendered to smooth the surface of the image-receiving layer and to enhance the evenness of the thermally transferred images.

The thickness and stiffness of the image-receiving sheet of the present invention are defined in view of the usage of the sheet, for example, as color prints, computer graphics, labels or cards. Usually, the image-receiving sheet of the present invention has a thickness of 60 to 200 μm and a Bekk surface smoothness of 200 seconds or more.

The cellulosic pulp material usable for the present invention include wood pulp materials consisting of a softwood pulp, a hardwood pulp and a mixture thereof. The wood pulp may be a kraft pulp, sulfite pulp, soda pulp, a pulp produced by using, as a pulping assistant, an anthraquinone compound, and a bleached pulp.

The bleached pulp may be produced by a usual bleaching method, for example, a chlorine treatment, alkali treatment, chlorine compound bleaching treatment, oxygen bleaching treatment, peroxide bleaching treatment, and reducing agent bleaching treatment, or a combination of two or more of the above-mentioned treatments.

Further, to increase the purity of the pulp, the kraft or soda pulping operation may be combined with a prehydrolysis treatment, and the sulfite pulping operation may be combined with an alkali extraction treatment at a high temperature.

Preferably, the sheet substrate consists essentially of a paper sheet comprising a low viscosity pulp material having a viscosity of 5 to 12 centipoises determined in accordance with the method of Tappi, T230, om-82. The low viscosity pulp material effectively enhances the surface smoothnesses of the sheet substrate and thus of the resultant image-resin sheet. The image-receiving sheet can record heat transferred images thereon with an excellent evenness, clarity, and sharpness in all of the range of from a light shade to a dark shade. Also, the resultant image-receiving sheet exhibits an increased resistance to curling due to partial heating of the sheet.

When the viscosity of the low viscosity pulp material is less than 5 centipoises, the resultant pulp fibers sometimes exhibit an unsatisfactory mechanical strength, and thus the resultant sheet substrate sometimes exhibits an unsatisfactory mechanical strength.

If the viscosity of the low viscosity pulp material is more than 12 centipoises, the resultant sheet substrate sometimes exhibits an unsatisfactory surface smoothness, and thus the resultant image-receiving sheet sometimes exhibits an unsatisfactory surface smoothness and a reduced evenness of dots formed thereon.

The viscosity of the pulp is proportional to the degree of polymerization of the pulp, and thus indicates a degree of chemical or mechanical deterioration of the pulp.

The low viscosity pulp material consists of pulp fibers having a small length, and can be easily beaten with substantially no or little affect on the whiteness of the pulp.

Namely, the low viscosity pulp material has a function as a fibrous filler for the paper sheet, and effectively increases the density or degree of tight packing and surface smoothness of the paper sheet.

Also, the low viscosity pulp material mixed with an ordinary pulp material in the paper-making process effectively decreases the formation of undesirable flocks of the pulp fibers during the wet paper-forming procedure and prevents the formation of wrinkles in the paper sheet during the drying procedure.

The resultant paper sheet containing the low viscosity pulp material exhibits a satisfactory mechanical strength even though the short pulp fibers having a lowered mechanical strength are mixed therein. This feature is obtained because the resultant paper sheet has an increased density.

Preferably, the low viscosity pulp material is contained in an amount of 10% to 70% based on the total weight of the pulp material.

If the content of the low viscosity pulp material is less than 10%, the resultant sheet substrate sometimes exhibits an unsatisfactory surface smoothness.

Also, when the content of the low viscosity pulp material is more than 70%, the resultant sheet substrate sometimes exhibits a lowered mechanical strength.

The sheet substrate usable for the present invention optionally contains one or more additives. The additives include dry paper strength-increasing agents, for example, cationic starch, cationized polyacrylamide, carboxy-modified polyvinyl alcohol, and anionized polyacrylamide; sizing agents, for example, fatty acid salts, rosin, and rosin derivatives such as maleic acid-modified rosin, dialkylketenedimer, alkenyl and alkyl succinates and polysaccharide esters; filters, for example, clay, kaolin, calcium carbonate, barium sulfate, titanium dioxide, aluminum hydroxide and magnesium hydroxide; fixing agents, for example, polyvalent metal salts such as aluminum sulfate and aluminum chloride, and cationized polymers; pH-controlling agents, for example, sulfuric acid, sodium hydroxide, and sodium carbonate; pigments, dyes, and fluorescent brightening agents.

The paper sheet usable for the sheet substrate is preferably tub-sized or size-pressed with an aqueous sizing liquid containing a water-soluble polymeric additive. The polymeric additive preferably consists of at least one member selected from cationic starch, polyvinyl alcohol, carboxyl-modified polyvinyl alcohol, carboxymethyl cellulose, hydroxyethyl cellulose, cellulose sulfate, gelatine, casein, sodium salts of polyacrylic acids, and sodium salts of styrene-maleic anhydride copolymers.

The sizing agent preferably consists of at least one member selected from petroleum resin emulsions, ammonium salts of styrene-maleic anhydride copolymer alkyl esters, alkylketene dimer emulsions, and latexes and emulsions of styrene-butadiene copolymers, ethylenevinyl acetate copolymers, polyethylenes, and vinylidene chloride copolymers.

The sizing liquid optionally contains an inorganic electrolytic substance, for example, sodium chloride or sodium sulfate, and a moisture-absorbing agent, for example, glycerin or polyethylene glycol.

The pigments include clay, kaolin, talc, barium sulfate, and titanium dioxide.

The paper sheet to be used as the sheet substrate is preferably compressed by using a calender, to increase the surface smoothness thereof.

Before laminating the front coating layer, the surface of the sheet substrate is preferably activated by applying a corona treatment, cold plasma treatment, flame treatment or other chemical or physical treatment, to enhance the bonding property of the sheet substrate surface.

In the image-receiving sheet of the present invention, the back coating layer may be coated with an antistatic layer comprising an anionic or cationic polymeric electrolytic material.

EXAMPLES

The present invention will be further explained by the following examples.

In the examples, the image-receiving properties of the resultant image-receiving sheets were tested and evaluated in the following manner.

In the thermal transfer type printer, yellow, magenta and cyan colored ink sheets each consisting of a substrate consisting of a polyester film with a thickness of a 6 μm and a wax-colored ink coating layer formed on a surface of the substrate and containing 50% by weight of a filler consisting of carbon black were used. A thermal head of the printer was heated stepwise at a predetermined heat quantity, and the heat-transferred images were formed in a single color or a mixed (superposed) color provided by superposing yellow, magenta, and cyan colored images.

The clarity (sharpness) of the images, the evenness of shading of the dots, the evenness of shading of close-printed portions, and the resistance of the sheet to thermal curling were observed by the naked eye and evaluated as follows:

| Class | Evaluation |
|---|---|
| 5 | Excellent |
| 4 | Good |
| 3 | Satisfactory |
| 2 | Not satisfactory |
| 1 | Bad |

EXAMPLE 1

A mixture of 20% by weight of a bleached softwood pulp (NBSP) produced by a sulfite pulping method and beaten to a Canadian standard freeness of 250 ml determined in accordance with JIS P-8121-76, 60% by weight of bleached hardwood pulp (LBKP) produced by a sulfate pulping method and beaten to a Canadian standard freeness of 280 ml and 20% by weight of a low viscosity hardwood pulp (LBKP) having a Canadian standard freeness of 250 ml was dispersed in water and the resultant pulp slurry was subjected to a wet papermaking process.

The low viscosity LBKP was produced by bleaching a commercial LBKP having a viscosity of 18 centipoises and a whiteness of 86% with a bleaching agent having a concentration of 6%, a pH of 9.0 and an active chlorine content of 2% at a temperature of 40° C., to decrease the viscosity of 10 centipoises. The pulp slurry contained the following additives.

| | |
|---|---|
| Cationic starch | 2.0% |
| Alkylketene dimer resin | 0.4 |
| Anionic polyacrylic amide resin | 0.1 |
| Polyamide-polyamineepichlorohydrin resin | 0.7 |

The pH of the pulp slurry was controlled to 7.0 by adding a sodium hydroxide solution.

The pulp slurry was converted to a paper sheet by using a wire paper machine, and the paper sheet was size-pressed with a size pressing agent and calendered in a usual manner. The resultant paper sheet had a weight of 170 g/m$^2$, a degree of packing of 1.0, and a moisture content of 8% by weight.

The size-pressing agent consisted of an aqueous solution of 5% by weight of a mixture of 2 parts by weight of carboxyl-modified polyvinyl alcohol and 1 part of weight of sodium chloride and was applied in an amount of 2.2 g/m$^2$ to two surfaces of the paper sheet.

The resultant paper sheet was used as a sheet substrate.

A polyethylene resin containing 10% by weight of titanium dioxide was melt extrude-coated at an amount of 30 g/m$^2$ on a front surface of the sheet substrate to form a front coating layer.

Also, a polyethylene resin was melt extrude-coated in an amount of 25 g/m$^2$ on the back of the sheet substrate while matting the surface of the resultant back coating layer.

The resultant front coating layer had a Bekk surface smoothness of 20,000 seconds and the back coating layer had a Bekk surface smoothness of 250 seconds.

The results of the image-receiving test are shown in Table 1.

EXAMPLE 2

The same procedures as those mentioned in Example 1 were carried out except that the sheet substrate had a weight of 64 g/m$^2$ and the amounts of each of the front coating layer and the back coating layer was 20 g/m$^2$.

The front coating layer had a Bekk surface smoothness of 600 seconds and the back coating layer had a Bekk surface smoothness of 600 seconds.

The test results are shown in Table 1.

COMPARATIVE EXAMPLE 1

A comparative image-receiving sheet was prepared by applying a super calender treatment to the same fine paper sheet as in Example 2.

The upper surface of the sheet had a Bekk surface smoothness of 300 seconds and the lower surface had a Bekk surface smoothness of 250 seconds.

The test results are shown in Table 1.

COMPARATIVE EXAMPLE 2

A synthetic paper-like sheet available under the trademark YUPO FP110, made by OJI YUKA GOSEISHI K.K., containing an inorganic pigment and having a thickness of 110 μm, was used as an image-receiving sheet.

The test results are shown in Table 1.

TABLE 1

| Example No. | Clarity of images | Shading evenness of dots | Shading evenness of close-printed portions | Superposed colored images | Resistance to thermal curling |
|---|---|---|---|---|---|
| Example 1 | 5 | 4 | 4 | 4 | 4 |
| Example 2 | 4 | 4 | 4 | 5 | 4 |
| Comparative Example 1 | 2 | 3 | 3 | 2 | 4 |
| Comparative Example 2 | 4 | 4 | 4 | 4 | 1 |

EXAMPLE 3

The same sheet substrate-preparing procedures as those described in Example 1 were carried out with the following exceptions. The pulp slurry contained 80% by weight of LBKP having a Canadian standard freeness of 280 ml and 20% by weight of a low viscosity NBSP having a Canadian standard freeness of 250 ml. The low viscosity NBSP was prepared by bleaching a commercial NBSP having a viscosity of 20 centipoises and a whiteness of 86% by the same method as mentioned in Example 1, and had a reduced viscosity of 11 centipoises.

A polyethylene resin containing 10% by weight of titanium dioxide was melt extrude coated at an amount of 30 g/m$^2$ on a front surface of the sheet substrate, to form front coating layer.

A polyethylene resin was melt extrude-coated in an amount of 25 g/m$^2$ on a back surface of the sheet substrate and the surface of the resultant back coating layer was matted. The resultant precursor sheet had a weight of 225 g/m$^2$.

The surface of the front coating layer was activated by a corona treatment and coated with 30 g/m$^2$ of a coating paste (1) having the following composition.

| Coating paste (1) | |
|---|---|
| Component | Amount (part by weight) |
| Calcined clay (*1) | 100 |
| Carboxy-modified styrene-butadiene copolymer latex (*2) | 20 |
| Polyacrylic acid sodium salt (dispersing agent) | 2 |

Note:
(*1) Trademark: Ansilex, made by Engelhalt Co.
(*2) Trademark: JSR 0668, made by Nihon Gosei Gomu K.K.

The surface of the resultant surface coating layer was smoothed by a super-calender treatment.

The Bekk surface smoothnesses of the surface coating layer and the back coating layer were 20,000 seconds and 250 seconds, respectively.

The test results are shown in Table 2.

EXAMPLE 4

The same sheet substrate-producing procedures as mentioned in Example 1 were carried out except that the content of the low viscosity LBKP was increased from 20% by weight to 40% by weight and the content of the other LBKP was reduced from 60% by weight to 40% by weight.

The same procedures as those in Example 3 were carried out except that the sheet substrate had a weight of 64 g/m$^2$, each of the front coating layer and the back coating layer had a weight of 15 g/m$^2$, and the surface coating layer having a weight of 20 g/m$^2$ was prepared from the following coating paste (2).

| Coating paste (2) | |
|---|---|
| Component | Amount (part by weight) |
| Fine silica particles (*3) | 100 |
| Carboxyl-modified styrene-butadiene copolymer latex | 20 |

Note: (*3) Trademark: Tokusil GUN, made by Tokuyama Soda K.K.

The resultant surface coating layer and back coating layer had Bekk surface smoothness of 18,000 seconds and 250 seconds, respectively.

The test results are shown in Table 2.

COMPARATIVE EXAMPLE 3

A surface of the same fine paper sheet as mentioned in Example 4 was directly coated with the coating paste (1) in an amount of 35 g/m$^2$ and the resultant coating layer was smoothed by a super-calender treatment.

The resultant front coating layer had a Bekk surface smoothness of 8500 seconds. The back surface of the sheet had a Bekk surface smoothness of 400 seconds.

The test results are shown in Table 2.

COMPARATIVE EXAMPLE 4

A surface of the same synthetic paper-like sheet as mentioned in Comparative Example 2 was coated with the coating paste (2) in an amount of 20 g/m$^2$ and then calendered by a super-calender.

The resultant front coating layer had a Bekk surface smoothness of 15,000 seconds. The back surface of the sheet had a Bekk surface smoothness of 400 seconds.

The printing test results are shown in Table 2.

TABLE 2

| Example No. | Clarity of images | Shading evenness of dots | Evenness of moderate harmony images | Superposed colored images | Resistance to thermal curling |
|---|---|---|---|---|---|
| Example 3 | 5 | 4 | 5 | 5 | 4 |
| Example 4 | 4 | 4 | 4 | 5 | 4 |
| Comparative Example 3 | 3 | 3 | 4 | 2 | 4 |
| Comparative Example 4 | 4 | 4 | 4 | 4 | 1 |

EXAMPLE 5

A mixture of 20% by weight of a bleached softwood pulp (NBSP) produced by a sulfite pulping method and beaten to a Canadian standard freeness of 250 ml determined in accordance with JIS P-8121-76, 60% by weight of bleached hardwood pulp (LBKP) produced by a sulfate pulping method and beaten to a Canadian standard freeness of 280 ml and 20% by weight of a low viscosity hardwood pulp (LBKP) having a Canadian standard freeness of 250 ml was dispersed in water and the resultant pulp slurry was subjected to a wet papermaking process.

The low viscosity LBKP was produced by bleaching a commercial LBKP having a viscosity of 18 centipoises and a whiteness of 86% with a bleaching agent having a concentration of 6%, a pH of 9.0 and an active chlorine content of 2% at a temperature of 40° C., to decrease the viscosity of 10 centipoises.

The pulp slurry contained the following additives.

| | |
|---|---|
| Cationic starch | 2.0% |
| Alkylketene dimer resin | 0.4 |
| Anionic polyacrylic amide resin | 0.1 |
| Polyamide-polyamineepichlorohydrin resin | 0.7 |

The pH of the pulp slurry was controlled to 7.0 by adding a sodium hydroxide solution.

The pulp slurry was converted to a paper sheet by using a wire paper machine, and the paper sheet was size-pressed with a size pressing agent and calendered in a usual manner. The resultant paper sheet had a weight of 170 g/m$^2$, a degree of packing of 1.0, and a moisture content of 8% by weight.

The size-pressing agent consisted of an aqueous solution of 5% by weight of a mixture of 2 parts by weight of carboxyl-modified polyvinyl alcohol and 1 part of weight of sodium chloride and was applied in an amount of 2.2 g/m$^2$ to two surfaces of the paper sheet.

The resultant paper sheet was used as a sheet substrate.

The surface smoothness of the sheet substrate was observed by the naked eye and evaluated as follows:

| Class | Evaluation |
|---|---|
| 5 | Excellent |
| 4 | Good |
| 3 | Satisfactory |
| 2 | Not satisfactory |
| 1 | Bad |

Also, the center plane average roughness (SRa) of the surface of sheet substrate was measured by using a three-dimensional roughness tester model SK-3AK made by Kosaka Kenkyusho in accordance with the method described in Japanese Unexamined Patent Publication No. 61-260240.

The test results are shown in Table 3.

The surface of the sheet substrate were activated by a corona treatment. A front surface of the sheet substrate was melt extrude-coated with a high density polyethylene resin having a specific gravity of 0.94 and a melt index of 6.8 and containing 10% by weight of anatase type titanium dioxide at a temperature of 320° C., and a front coating layer having a thickness of 28 μm was obtained.

The back surface of the sheet substrate was melt extrude-coated with the same polyethylene resin as mentioned above, which was free from the pigment, at a temperature of 320° C., and the surface of the resultant back coating layer was matted by pressing with a matted peripheral surface of a cooling roll under a pressure of 20 kg/cm. The back coating layer had a thickness of 28 μm.

The surface of the front coating layer was coated with a toluene solution of 20% by weight of a polyester resin and containing 5% by weight of titanium dioxide to form a surface coating, layer in a weight of 5 g/m$^2$ The resultant image-receiving sheet was subjected to a printing test using a subliminary dye-thermal transfer type printer. The results are shown in Table 3.

EXAMPLE 6

The same procedures as those described in Example 5 were carried out with the following exceptions. The pulp slurry contained 80% by weight of LBKP having a Canadian standard freeness of 280 ml and 20% by weight of a low viscosity NBSP having a Canadian standard freeness of 250 ml. The low viscosity NBSP was prepared by bleaching a commercial NBSP having a viscosity of 20 centipoises and a whiteness of 86% by the same method as mentioned in Example 5, and had a reduced viscosity of 11 centipoises.

The test results are shown in Table 3.

EXAMPLE 7

The same procedures as mentioned in Example 5 were carried out except that the content of the low viscosity LBKP was increased from 20% by weight to 40% by weight and the content of the other LBKP was reduced from 60% by weight to 40% by weight.

The test results are shown in Table 3.

COMPARATIVE EXAMPLE 5

A comparative image-receiving sheet was prepared by coating a surface of a multilayered biaxially oriented porous polypropylene film (available under the trademark YUPO PG 150, made by OJI YUKA GOSEISHI K.K.) with 5 g/m$^2$ of the same polyester resin as mentioned in Example 5.

The test results are shown in Table 3.

TABLE 3

| Item | | | Example No. | | | |
|---|---|---|---|---|---|---|
| | | | Example | | | Comparative |
| | | | 5 | 6 | 7 | Example 5 |
| Pulp composition (% by weight) | | | | | | |
| Type | Freeness (ml) | Viscosity (CPS) | | | | |
| NBSP | 250 | — | 20 | — | 20 | — |
| LBKP | 280 | — | 60 | 80 | 40 | — |
| Low viscosity NBSP | 250 | 11 | — | 20 | — | — |
| Low viscosity LBKP | 250 | 10 | 20 | — | 40 | — |
| Surface smoothness of sheet substrate | | | | | | |
| Center plane average roughness (SRa) (μm) | | | 2.6 | 1.5 | 1.9 | 0.8 |
| Naked eye evaluation | | | 3 | 5 | 4 | 5 |
| Heat transferred image | | | | | | |
| Clearness | | | 5 | 5 | 5 | 4 |
| Evenness of shading | | | 3 | 4 | 4 | 5 |
| Resistance to thermal curling | | | 5 | 5 | 5 | 1 |

We claim:

1. A thermal transfer image-receiving sheet comprising:

a sheet substrate;

a front coating layer formed on a front surface of the sheet substrate having a weight of 2 to 50 g/m$^2$ and comprising, as a principal component, a polyolefin resin material which comprises:

at least one member selected from the group consisting of polyethylene resins;

polypropylene resins, polybutene resins, polypentene resins and copolymer resins of at least two of ethylene, propylene, butene and pentene;

and a white pigment dispersed in said polyolefin resin material in an amount of 5 to 20% by weight;

a back coating layer formed on a back surface of the sheet substrate having a weight of 2 to 50 gm/$^2$ and comprising, as a principal component, a polyolefin resin material, said sheet substrate consisting essentially of a paper sheet, having a basis weight of 20 to 250 g/m$^2$, and comprising a pulp material which includes a low viscosity pulp material fraction having a viscosity of 5 to 12 centipoises determined in accordance with the method of Tappi T 230, om-82, and in an amount of 10 to 70% based on the total dry weight of the pulp material.

2. The image-receiving sheet as claimed in claim 1, wherein said white pigment is selected from the group consisting of titanium dioxide, zinc sulfide, zinc oxide, calcium sulfate, calcium sulfite, aluminum hydroxide barium sulfate, clay, talc, kaolin, light and heavy calcium carbonates, silica and calcium silicate.

3. The image-receiving sheet as claimed in claim 1, which further comprises a surface coating layer formed on said front coating layer which comprises a resinous binder and a pigment.

4. The image-receiving sheet as claimed in claim 3, wherein said surface coating layer comprises 5 to 90% by weight of said pigment.

5. The image-receiving sheet as claimed in claim 3, wherein said surface coating layer comprises a resinous binder consisting essentially of at least one member selected from the group consisting of styrene-butadiene copolymers, methyl methacrylate-styrene-butadiene copolymers, vinyl acetate homopolymer and copolymers, and acrylic polymers; and a white pigment, dispersed in said resinous binder, having an oil absorption, as determined in accordance with JIS K 5101, of 30 to 400 ml/100 g and in an amount of 10 to 90% by weight.

* * * * *